United States Patent [19]

Yuge et al.

[11] Patent Number: 4,676,192

[45] Date of Patent: Jun. 30, 1987

[54] DRY PROCESS DEVELOPING APPARATUS

[75] Inventors: Shizuo Yuge, Toyokawa; Susumu Sakakibara, Toyohashi, both of Japan

[73] Assignee: Minolta Camera Kabushiki Kaisha, Osaka, Japan

[21] Appl. No.: 654,670

[22] Filed: Sep. 26, 1984

[30] Foreign Application Priority Data

Sep. 30, 1983 [JP] Japan ..... 58-183633
Jun. 1, 1984 [JP] Japan ..... 59-113618

[51] Int. Cl.[4] ..... G03G 15/09

[52] U.S. Cl. ..... 118/658; 118/657; 355/3 DD

[58] Field of Search ..... 118/657, 658; 355/3 DD

[56] References Cited

U.S. PATENT DOCUMENTS 4,331,757 5/1982 Tanaka et al. ..... 118/657 X
4,334,497 6/1982 Oka et al. ..... 118/657 X
4,383,498 5/1983 Yamashita ..... 118/657
4,406,535 9/1983 Sakamoto et al. ..... 118/658 X
4,438,722 3/1984 Forlani ..... 118/657

*Primary Examiner*—Bernard D. Pianalto
*Attorney, Agent, or Firm*—Wenderoth, Lind & Ponack

[57] ABSTRACT

A dry process developing apparatus of a type in which, by supplying toner contained in a toner replenishing tank with respect to magnetic carrier magnetically attracted onto an outer peripheral surface of a developing sleeve, a magnetic developing material composed of the magnetic carrier and toner is prepared on the outer peripheral surface of the developing sleeve for developing an electrostatic latent image supported on the surface of an electrostatic latent image support member by the use of this developing material. The developing apparatus includes a space chamber defined between a bristle height restricting member and a front restricting member so as to open towards the outer peripheral surface of the developing sleeve, and preliminarily loaded with the magnetic carrier, and a toner supplying section for supplying the toner with respect to the outer peripheral surface of the developing sleeve at the upstream side of the front restricting member.

10 Claims, 7 Drawing Figures

DRY PROCESS DEVELOPING APPARATUS

BACKGROUND OF THE INVENTION

The present invention generally relates to a developing apparatus and more particularly, to a dry process developing apparatus for use in a copying process such as electrographic copying or the like.

Dry developing processes which have already been put into actual applications at present may be broadly divided into the dual-component or two-component developing process which employs a developing material in a powder form composed of a mixture of toner and magnetic carrier, and the mono-component or one-component developing process which employs a developing material in a powder form composed of only magnetic toner. In the above two-component developing process, although developing and transfer characteristics of the toner itself are superior, there are some problems related to deterioration of carrier and stability of the mixing ratio of the toner to the carrier. Meanwhile, since the one-component developing process is free from any problem due to employment of carrier, it has been a recent tendency for this process to be adopted in many copying apparatuses.

However, with respect to toner, there is a difficult problem in that conditions incompatible with each other, i.e. conditions for electrical conductivity during the development and conditions for electrical insulation during the transfer are required. At the present stage, it is intended to improve the developing characteristics through adoption of various countermeasures by employing electrically insulative magnetic toner having favorable transfer characteristics, without imposing excessive loads on the copying process.

Subsequently, a comparative study will be made between a process in which toner is formed into a thin layer for effecting the developing and another process in which toner is formed into a layer having a thickness to a certain extent through employment of a charging type magnetic toner for the toner.

In the latter thick layer process, if there are no differences between toner particles in the physical properties and surface condition of the toner, the toner can favorably effect triboelectrical charging with respect to a developing sleeve, but part of the toner at the upper part of the layer is hardly charged triboelectrically, thus resulting in a faulty developing. However, if there is a predetermined distribution in the physical properties and/or the surface condition of the toner, the toner at the upper part of the layer can be subjected to the triboelectric charging between the toner particles. In other words, the toner is provided with stable charging characteristics when there is a difference in a triboelectric series, which makes it possible to effect a favorable development. On the other hand, in the former thin layer process, a favorable development may be achieved only if the toner has a difference in the triboelectric series with respect to the developing sleeve, but there is such a disadvantage that the developed images are substantially low in density since the toner layer is thin.

Incidentally, when developing experiments are actually carried out using the thick layer process as described above, it is possible to effect a stable development. The reasons are such that, since the amount of magnetic powder exposed to surfaces of toner particles and amounts of exposed additives such as dye, carbon black, etc. are different according to dispersion, classification, aftertreatment process, etc. during manufacture of toner, there is produced a difference in the triboelectric series between the toner particles, thus resulting in the triboelectric charging of the toner particles to each other. However, when the ratio of inversely charged toner (it is to be noted that originally, individual toner particles are negatively charged by the triboelectric charging thereof with respect to the developing sleeve) in the developing material becomes high, probability of contact between the inversely charged toner and the developing sleeve is increased, with a consequent transfer of the charging polarity to the original negative polarity. In connection with the above, upon separation of only the inversely charged toner, it has been found that the magnetic powder content is high. Since the toner as described above is poor in charge retaining characteristic, and tends to produce a leakage of charge during transportation thereof along a peripheral surface of the developing sleeve, it may be considered that transfer of the charging polarity is easily effected.

Even the thick layer process as described so far has such disadvantages that the developing gap and the magnetic brush bristle height restricting gap employed therein are generally narrow, with a high accuracy being required therefor, while the bristle height restricting gap tends to be clogged by the toner. Moreover, the charging mechanism depends on the state of manufacture of the toner in terms of probability, and it is difficult to reproduce such a state of manufacture of the toner in exactly the same manner. Furthermore, since the toner concentration is at 100%, variation of the toner amount at the developing region is likely to become conspicuous.

In order to overcome the drawbacks as described in the foregoing, it has been considered by the present inventors to mix magnetic carrier into the toner layer on the outer peripheral surface of the developing sleeve.

In FIG. 1, there is shown a basic construction of a conventional developing apparatus employed for the one-component developing process, which generally includes a cylindrical developing sleeve 1 rotatably provided adjacent to a photosensitive surface 5*a* of a photosensitive or photoreceptor drum 5, for rotation in a direction indicated by an arrow b, a magnet roller 2 sequentially magnetized with S and N poles at its outer peripheral surface and rotatably accommodated in the developing sleeve 1 for rotation in a direction indicated by an arrow a, a bristle height restricting plate 3 fixedly provided above and adjacent to the peripheral surface of the developing sleeve 1, and a toner tank 4 in which toner is contained. By the rotation of the magnet roller 2 in the direction of arrow a and the rotation of the developing sleeve 1 in the direction of arrow b, the toner is transported for circulation along the peripheral surface of the developing sleeve 1 in the direction of arrow b so as to be rubbed against an electrostatic latent image preliminarily formed on the photosensitive surface 5*a* of the photoreceptor drum 5 driven for rotation in a direction indicated by an arrow c, thereby to develop said electrostatic latent image. In the above case, the amount of toner transported to the developing region A is restricted by the bristle height restricting plate 3.

In the developing apparatus as described above, when the developing is effected by mixing magnetic carrier into the toner layer on the outer peripheral surface of the developing sleeve 1, there was observed by the present inventors a phenomenon that part of the carrier was collected at the upstream side B of the bristle height restricting plate 3 in the direction for transporting the developing material and thereafter, dispersed into the toner contained in the toner tank 4 as shown by an arrow d upon application of the toner transporting force, etc. thereto. In other words, as the developing proceeds, the amount of carrier transported to the developing region A is reduced, with a variation (rising) of toner concentration, or the triboelectric charging between the toner and carrier becomes insufficient, thus making it impossible to obtain developed images of high quality. This also means that the toner concentration can not be set at a predetermined value. Moreover, there is a disadvantage that, if irregularity of the toner concentration takes place in the axial direction of the developing sleeve 1, such an irregular toner concentration is not readily eliminated, since it is difficult to subject the toner and carrier positively to a moving force in the axial direction.

SUMMARY OF THE INVENTION

Accordingly, an essential object of the present invention is to provide a dry process developing apparatus for use in a copy process such as electrographic copying, which is suited to a developing process employing sham monocomponent developing material having a small amount of starter carrier mixed thereinto, and capable of stabilizing toner concentration, achieving a sufficient triboelectric charging between the toner and carrier, and also effectively eliminating the irregular toner concentration in the axial direction of a developing sleeve.

Another important object of the present invention is to provide a dry process developing apparatus of the above described type, in which magnetic carrier in the magnetic developing material transported for circulation in one direction along the outer peripheral surface of the developing sleeve is positively prevented from being dispersed into the toner contained in a toner replenishing tank during operation of the apparatus.

A further object of the present invention is to provide a dry process developing apparatus of the above described type, which has a simple construction and is stable in functioning, and can be readily incorporated into electrographic copying apparatuses and the like at low cost.

In accomplishing these and other objects, according to one preferred embodiment of the present invention, there is provided a dry process developing apparatus for use in a copying process, which includes a developing sleeve having a magnet member provided therein, a driving means for driving and rotating the developing sleeve and/or the magnet member so as to transport a developing material along the outer peripheral surface of the developing sleeve, a bristle height restricting member provided at an upstream side of a developing region in the direction of transportation of the developing material for restricting the height of magnetic brush bristles, a front restricting member provided at an upstream side of the bristle height restricting member, a chamber for carrier accommodation which is opened towards the outer peripheral surface of the developing sleeve, in a position between the bristle height restricting member and the front restricting member and in wich the magnetic carrier is preliminarily loaded, and a toner supplying means for supplying the toner with respect to the outer peripheral surface of the developing sleeve at an upstream side of the front restricting member, so that the magnetic developing material composed of a mixture of the magnetic carrier and toner is prepared on the outer peripheral surface of the developing sleeve by supplying the toner contained in a toner replenishing tank with respect to the magnetic carrier magnetically attracted onto the outer peripheral surface of the developing sleeve, thereby to develop an electrostatic latent image supported on surface of an electrostatic latent image support member by using the magnetic developing material.

By the above arrangement and further modifications thereof to be described later according to the present invention, an improved dry process developing apparatus has been advantageously provided, with substantial elimination of disadvantages inherent in the conventional arrangement of this kind.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
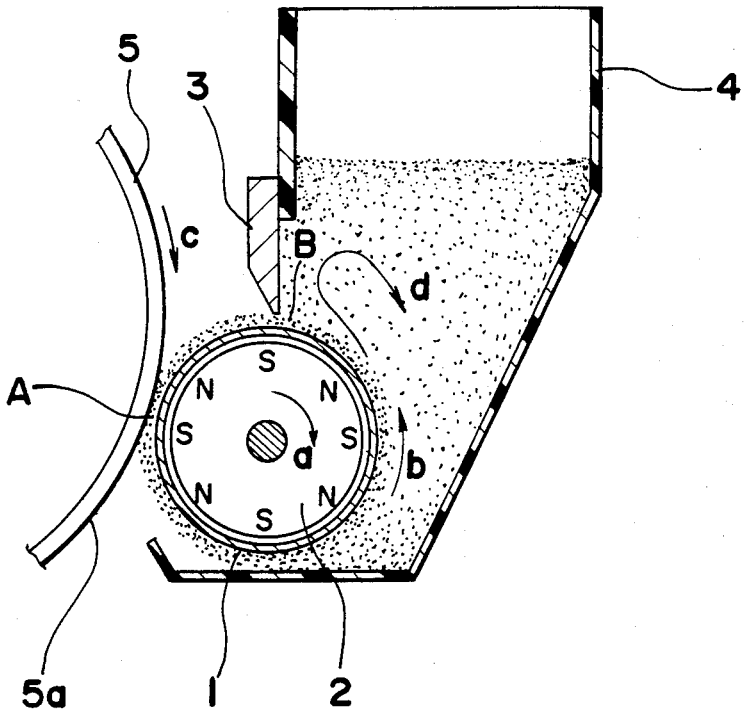
Fig. 1 PRIOR ART
FIG. 1 is a side sectional view of a conventional dry process developing apparatus (already referred to)

Before the description of the present invention proceeds, it is to be noted that like arts are designated by like reference numerals throughout the accompanying drawings.

Figure 2:
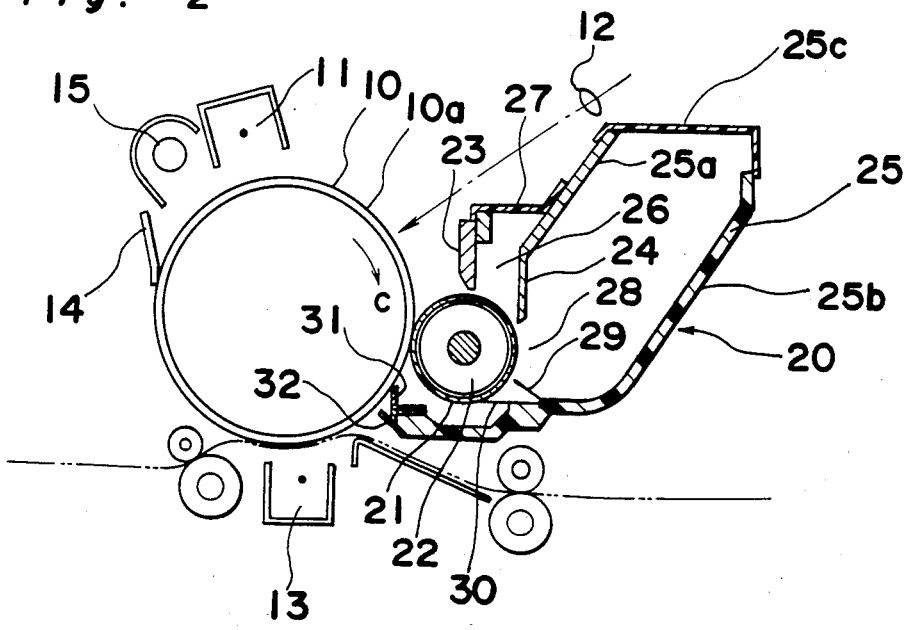
FIG. 2 is a side sectional view showing the positional relation of a dry process developing apparatus according to one preferred embodiment of the present invention with respect to a photosensitive drum of an electrographic copying machine.
Figure 3:
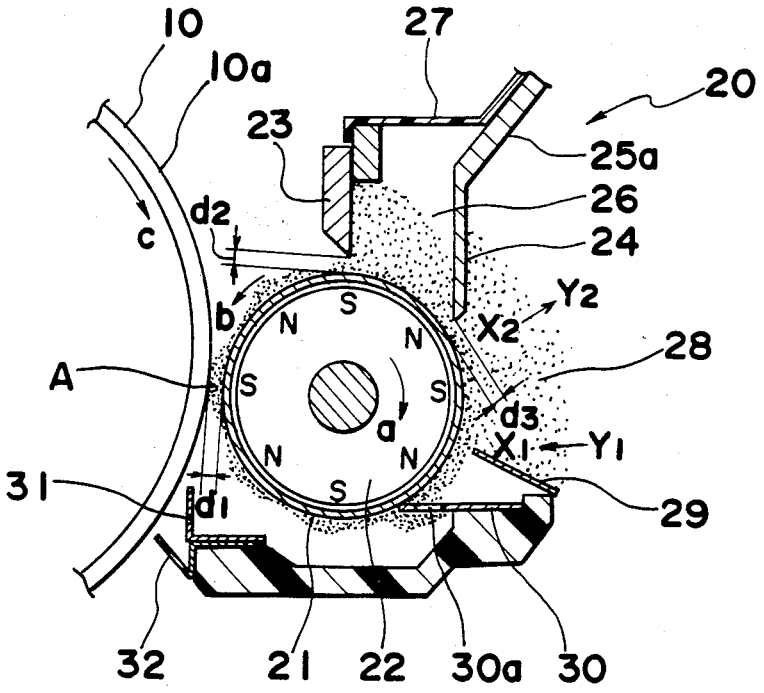
FIG. 3 is a fragmentary side sectional view showing, on an enlarged scale, an essential portion of the dry process developing apparatus of FIG. 2.

Referring now to the drawings, there is shown in FIGS. 2 and 3 a dry process developing apparatus according to one preferred embodiment of the present invention.

In the first place, the general construction of a copying machine, to which the dry process developing apparatus of the present invention may be applied, will be described hereinbelow with reference to FIG. 2. The copying machine generally includes a photosensitive or photoreceptor drum 10 having a photosensitive surface 10*a* and arranged to be driven for rotation at a constant speed in a direction indicated by arrow c, and various processing devices such as a corona charger 11, an image exposing means 12, the dry process developing apparatus 20 according to the present invention, a transfer charger 13, a cleaning blade 14 for removing remaining toner from the photosensitive surface 10*a*, and an eraser lamp 15 for erasing residual charge, etc. sequentially disposed around the photoreceptor drum 10 as illustrated. As shown by a two-dotted chain line in FIG. 2, a copy paper sheet is arranged to be fed from the right side towards the left side, and after the transfer process, discharged out of the copying apparatus through a fixing device (not shown).

On the other hand, the dry process developing apparatus 20 according to the present invention includes a developing sleeve 21 of an electrically conductive non-magnetic material formed into a cylindrical configuration and provided adjacent to the photosensitive surface 10*a* of the photoreceptor drum 10 for rotation in the direction of arrow b, a magnet roller 22 sequentially magnetized with S and N poles at the outer peripheral surface thereof and coaxially provided in the developing sleeve 21 for rotation in the direction of arrow a, with a bristle height restricting plate 23 being disposed above and adjacent to the surface of the developing sleeve 21. By the rotation of the magnet roller 22 in the direction of arrow a and the rotation of the developing sleeve 21 in the direction of arrow b, the developing material is transported for circulation along the outer peripheral surface of the developing sleeve 21 in the direction of arrow b. At an upstream side of the bristle height restricting plate 23, there is further provided a front restricting plate 24 for the developing material, which is integrally formed with a housing or side wall 25*a* of a toner replenishing tank 25, with the forward edge of said front restricting plate 24 confronting the outer peripheral surface of the developing sleeve 21. A chamber 26 is formed between the bristle height restricting plate 23 and the front restricting plate 24. The upper portion of the above chamber 26 is covered by a covering plate 27 for selective opening or closing, and the chamber 26 is opened, at its lower portion, only towards the outer peripheral surface of the developing sleeve 21.

Meanwhile, the lower portion of the toner replenishing tank 25 defined by the housing including the side wall 25*a*, another side wall 25*b*, and a lid member 25*c*, etc. is formed into a toner supplying section 28 open towards the upstream side of the front restricting plate 24, while a plate member 29 for forming a bottom portion of the toner replenishing tank 25 is provided on the wall 25*b* at the lower part of the toner supplying section 28, with a scraper 30 having a hole 30*a* formed therein being further provided in a position below the plate member 29 so as to contact under pressure the outer peripheral surface of the developing sleeve 21 in a so-called forward direction. There are also provided developing material scattering preventing plates 31 and 32 in position at the lower edge of the toner replenishing tank 25 and below a developing region A.

Using the above arrangement, the present inventors have carried out various developing experiments through variations of such conditions as the gap d1 between the photosensitive surface 10*a* of the photoreceptor drum 10 and the outer peripheral surface of the developing sleeve 21 at the developing region A, the gap d2 between the bristle height restricting plate 23 and the outer peripheral surface of the developing sleeve 21, and the gap d3 between the front restricting plate 24 and the outer peripheral surface of said developing sleeve 21, etc. or by altering the kind of toner and carrier, with favorable results being obtained respectively.

Some of the above experiments will be described hereinbelow for the purpose of illustrating the present invention, without any intention of limiting the scope thereof.

(EXPERIMENT I)

Gap d1=0.60 mm
Gap d2=0.40 mm
Gap d3=1.20 mm
Magnet roller:
  Magnetic force: 750 G
  No. of poles: 8
  Revolutions: 800 rpm (in the direction of arrow a)
Developing sleeve:
  Outer diameter: 31 mm
  Revolutions: 80 rpm (in the direction of arrow b)
Processing speed (circumferential speed of photoreceptor drum): 130 mm/sec
Carrier: manufactured by Nippon Iron Powder Co., Ltd.
  Name used in trade: F-182
  Average particle dia.: 65–70 μm
  Loading amount: 40 g
Toner: charging type magnetic toner
  Magnetic powder content: 40 wt%
Electrostatic latent image potential: +400 V (max. potential)
Developing bias:
  DC +100 V
  AC 600 Hz, 500 Vrms In the above Experiment I, 60,000 copy paper sheets were subjected to copying, but consumption of the carrier on the outer peripheral surface of the developing sleeve 21 was hardly noticed, nor was there any deterioration of the carrier itself.

(EXPERIMENT II)

Magnet roller: Fixed
Developing sleeve Revolutions: 80 rpm (in the direction of arrow b)
Carrier: manufactured by Nippon Iron Powder Co., Ltd.
  Name used in trade: F-182
  Average particle dia.: 65–70 μm
  Loading amount: 40 g
Toner: charging type magnetic toner
  Magnetic powder content: 15 wt%

Other conditions were generally the same as in Experiment I.

In the above Experiment II, trial products of sepia toner in which the amount of magnetic powder was reduced, and green toner in which 5 to 10 wt% of TiO+ pigment was contained, were employed to replace the toner referred to above, and both of such trial products of color toner also provided favorable copied images.

(EXPERIMENT III)

Gap d1=0.50 mm
Gap d2=0.30 mm
Gap d3=1.00 mm
Carrier: manufactured by Fuji Electrochemical Co., Ltd.
  Name used in trade: X-012
  Average particle dia.: 45 μm
  Loading amount: 80 g
Toner: charging type non-magnetic toner Electrostatic latent image potential: +400 V (max. potential)

Developing bias: DC +150 V

Subsequently, behavior of the carrier and toner, and mechanism of the developing will be explained.

The carrier is first loaded into the chamber 26 by opening the covering plate 27, and upon actuation of the developing apparatus, is placed on the outer peripheral surface of the developing sleeve 21. In the above case, the toner may be preliminarily mixed to a certain extent in the carrier. Thereafter, the toner is loaded in the toner replenishing tank 25 and fed onto the outer peripheral surface of the developing sleeve 21 from the toner supplying section 28. By the rotation of the magnet roller 22 in the direction of arrow a and the rotation of the developing sleeve 21 in the direction of arrow b, the toner is transported for circulation in the direction of arrow b along the outer peripheral surface of the developing sleeve 21, and stirred and mixed with the carrier while passing through the chamber 26 so as to be charged to a negative polarity by the triboelectric charging with respect to the carrier and/or triboelectric charging with respect to the developing sleeve 21. In the actual practice, the developing is effected in a state where the toner and carrier are sufficiently mixed with each other for developing an electrostatic latent image formed, in a positive polarity, on the photosensitive surface 10*a* of the photoreceptor drum 10 at the developing region A.

After the developing, the toner is further transported through a hole 30*a* of the scraper 30 in the direction of arrow b together with the carrier, and at the toner supplying section 28, is supplied with fresh toner, and then, remains in the chamber 26 for a while so as to be stirred and mixed thereat for again being transported to the developing region A subsequently.

In the above case, although the amount of the developing material transported to the developing region A is restricted by the gap d2 at the bristle height restricting plate 23, since the gap d3 at the front restricting plate 24 is set to be larger than the gap d2, all the carrier reaches the chamber 26 through the gap d3. Here, the carrier and toner restricted by the bristle height restricting plate 23 stay within the chamber 26 so as to be stirred and mixed also in the axial direction of the developing sleeve 21, but such carrier and toner, especially the carrier, is stirred only within the chamber 26, without being dispersed or diffused into the toner contained in the toner replenishing tank 25 through the toner supplying section 28. Thus, the toner concentration at the developing region A is determined by the amount of the carrier loaded in the chamber 26. Accordingly, the toner concentration of the developing material at the developing region A is maintained at a constant value at all times. Moreover, by preliminarily adjusting the amount of carrier to be loaded into the chamber 26, it is possible to set the toner concentration accurately and as desired.

In the above case, it is necessary for the gap d3 at the front restricting plate 24 to allow to pass therethrough, a greater amount of the developing material than the gap d2 at the bristle height restricting plate 23. In other words, the gap d3 is required to have a size sufficient to allow all the developing material including the carrier to pass therethrough, and the front restricting plate 24 partitions between the chamber 26 and the toner replenishing tank 25 so as to prevent the carrier staying in the chamber 26 from dispersing or diffusing into the toner contained in the toner replenishing tank 25. Moreover, not only is the triboelectric charging between the toner and carrier sufficiently effected during passage of the developing material through the chamber 26, but also the uneven toner concentration in the axial direction may be effectively eliminated. If the gap d3 is narrow, permitting less amount of the developing material to pass therethrough than the gap d2, the carrier tends to stay at the portion of the front restricting plate 24, and dispersion or diffusion of the carrier can not be prevented.

It is to be noted here that, in order to improve the transporting force of the developing material by the developing sleeve 21, the outer peripheral surface of the developing sleeve 21 may be formed with minor undulations or concave and convex portions by a blast processing, etc.

On the other hand, for the magnetic carrier, there may be employed iron carrier, ferrite carrier and resin coated carrier thereof, and further, binder carrier, etc. which is prepared by bonding together fine magnetic powder with a resin. Meanwhile, for the toner, it is possible to employ magnetic toner or non-magnetic toner, and the content of the magnetic powder should preferably be less than 40 wt%, since the fixing property of the toner deteriorates as the magnetic powder content becomes high, and upon exceeding 40 wt%, the toner concentration at the developing region tends to be lowered. As described above, in the case where the magnetic powder is contained in the toner, coloring is difficult as compared with the case of the non-magnetic toner, although soiling of the apparatus does not easily take place due to scattering of the developing material, etc. even if the toner is not sufficiently triboelectrically charged with respect to the carrier. More specifically, in the above case, it is necessary to add $TiO_2$, etc. to eliminate the color of the magnetic powder, with further addition thereto of a dye, pigment or the like, and the addition of $TiO_2$, etc. adversely affects the mutual triboelectric charging between the toner particles. However, in the case of the magnetic toner, there is an advantage that the image quality may be improved through impression of an AC developing bias.

In the case where the non-magnetic toner is employed, since the triboelectric charging between the toner particles can not be utilized, the toner tends to be scattered unless the triboelectric charging thereof with respect to the carrier is sufficiently effected, and thus, it is necessary to suppress the toner concentration (at the developing region) so that it is low as compared with the case where the magnetic toner is employed. For this purpose, the front restricting plate 24 can be made of a magnetic material to form a so-called carrier curtain at the portion where the front restricting plate 24 is provided for suppressing the amount of toner to be supplied from the toner supplying portion 28. Meanwhile, in order to guarantee still more sufficient triboelectric charging between the toner and carrier, the circumferential length of the chamber 26 may be increased so as to increase the amount of carrier staying in the chamber 26.

Subsequently, the function of the carrier with respect to the toner will be explained.

In the first place, the carrier has the function to achieve a positive triboelectric charging of the toner. In addition to the above function, the carrier also electrostatically attracts the toner triboelectrically charged with respect to the carrier and/or the developing sleeve transportation thereof to the developing region A under the state where the toner charge is retained. In the conventional case where the toner layer is thick, the toner at the upper part of the layer can hardly retain a charge although provided with a counter charge, but mixing the carrier into the toner layer guarantees such retaining of charge, while functioning to increase the transporting force by improving the permeability. In other words, by the presence of the carrier, the substantial magnetic field intensity at the developing region A is increased, and this is effective for removal of fogging in the case of the magnetic toner. Furthermore, by the rising of the dielectric constant at the developing region A, the substantial magnetic field intensity is increased, i.e., it becomes possible to lower the substantial toner concentration, with the toner layer being kept as it is in a thick layer, without the necessity for forming the toner layer into a thin layer.

For example, in the case of the charging type magnetic toner, inversely charged toner having the function of a carrier is present in such toner, and is subjected to developing (i.e., adhesion) on the developing sleeve 21 during the development. Therefore, it is necessary to scrape off this inversely charged toner by a scraper and return it again onto the outer peripheral surface of the developing sleeve 21. In the case where carrier is mixed into the toner as in the present invention, the carrier is assumed to be subjected to developing (i.e, adhesion) on the developing sleeve 21, but owing to the strong magnetic force, it is favorably transported without being kept adhered onto the developing sleeve 21. Accordingly, in the foregoing embodiment, although the scraper 30 with the hole 30*a* is provided at the downstream of the developing region A for scraping off the developing material from the developing sleeve 21, such scraper is not necessarily required to be provided. However, by the provision of said scraper 30 with the hole 30*a*, the stirring and mixing efficiency may be improved.

Hereinbelow, the characteristic (charging characteristic) required for the toner will be described.

Figure 4:
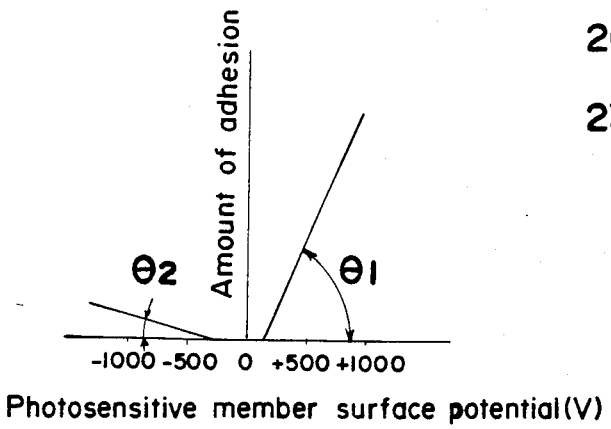
FIG. 4 is a graph showing a charging characteristic of toner.

Toner is required to have a triboelectric charging property with respect to the carrier, developing sleeve, etc., and to be provided with such characteristics that the amount of adhesion thereof to the electrostatic latent image at the side of the toner polarity to be charged by the friction with respect to the carrier when the toner is used alone for developing, is more than two times the amount of adhesion thereof at the opposite polarity. In other words, as shown in FIG. 4, this means that, in the case of negatively charged toner having a larger amount of adhesion to the electrostatic latent image at the side of positive polarity, the relation is represented by $\tan\theta 1/\tan\theta 2 \geqq 2$. By the above relation, it is meant that the toner itself has a charging characteristic, and since the toner with the charging characteristic is subjected to triboelectric charging also between toner particles thereof although it is triboelectrically charged with respect to the carrier, developing sleeve, etc., upon comparison of developing characteristics between single toners, the charging characteristic is varied according to the chargeability of the respective single toners, with a consequent variation of the amount of adhesion.

In other words, the toner has a selectivity for the polarities. By imparting such charging characteristic to the toner, it becomes possible to obtain a developing material having a high mixing ratio of the effective toner.

However, in the case where $\tan\theta 1/\tan\theta 2$ is smaller than 2, it is impossible to achieve a high ratio of the effective toner, because in the above case, since the number of toner particles inversely charged is large, it becomes difficult to bring polarities of toner into agreement by causing all the toner to be triboelectrically charged with respect to the carrier. Accordingly, the amount of toner having a sufficient charge is decreased, with a reduction in the image density.

Referring back to FIGS. 2 and 3, the cover plate 27 provided at the upper portion of the chamber 26 is intended not only to permit loading of a predetermined amount of carrier in the chamber 26 at the start, but also to take out or replenish the carrier in the case where the deterioration or consumption of the carrier takes place for some reason.

Figure 5:
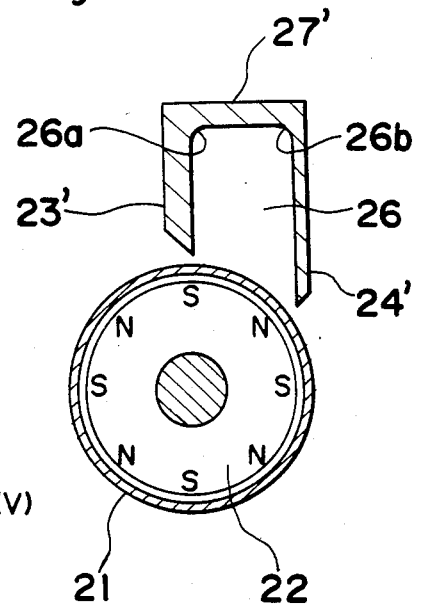
FIG. 5 is a fragmentary side sectional view showing a modification of the dry process developing apparatus of FIG. 2.

As shown in the modification of FIG. 5, the bristle height restricting plate 23', the front restricting plate 24' and the cover plate 27' may be integrally molded into one unit, for example, of a resin material, if a replenishing and taking out portion (not particularly shown) for the carrier is separately provided. Moreover, when a proper radius of curvature is provided at each of the corner portions 26*a* and 26*b*, a smooth flow or circulation of the developing material within the chamber 26 may be achieved, and entry of an excessive amount of toner from the toner replenishing tank 25 can be prevented still more positively, although in the foregoing experiments, the entry of an execessive amount of toner which may invite a problem, has not actually taken place. Meanwhile, in order to prevent the entry of an excessive amount of toner as referred to above, it is also effective, in the case of a magnet roller fixed type developing apparatus, to cause one of the magnetic poles of the magnet roller 22 and the front restricting plate 24' to confront each other. In the above case, not only can the gap d3 be increased owing to rising of the developing material at the forward edge of the front restricting plate 24' confronting said one magnetic pole by the action of the magnetic field, but the entry of an excessive amount of toner from the toner supplying section 28 can be advantageously prevented.

Figure 6:
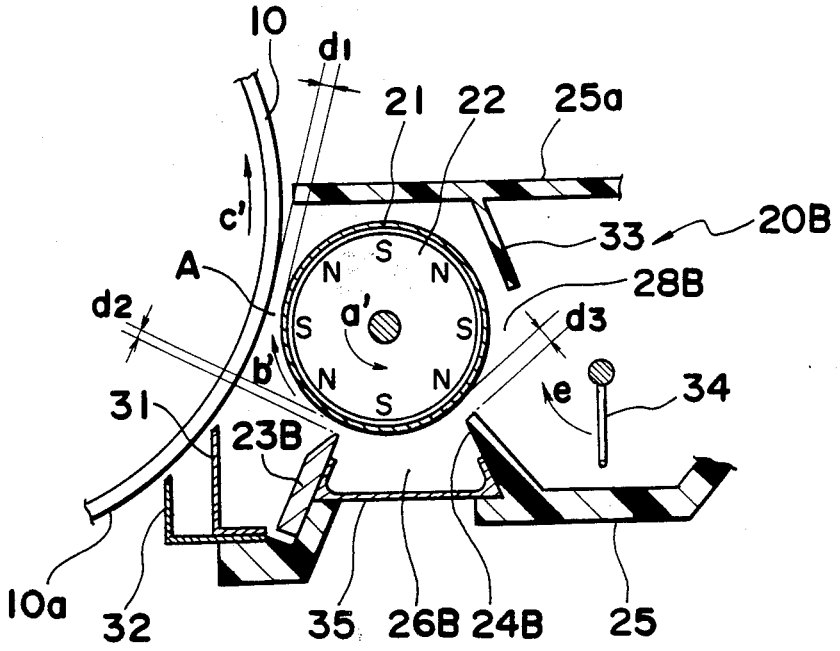
FIG. 6 is a view similar to FIG. 2, which particularly shows a second embodiment thereof.

Referring to FIG. 6, there is shown a dry process developing apparatus 20B according to a second embodiment of the present invention, in which a bristle height restricting plate 23B, and a front restricting plate 24B are provided below the developing sleeve 21, with a chamber 26B being formed by a cartridge 35 of a receiving dish type adapted to be inserted or withdrawn in the axial direction of the developing sleeve 21, and thus, the initial loading or replacement of the carrier, etc. may be effected by the selective insertion or withdrawal of the cartridge 35. By the rotation of the magnet roller 22 in the direction of arrow a' and the rotation of the developing sleeve 21 in the direction of arrow b', the developing material is circulated for transportation over the outer peripheral surface of the developing sleeve 21 in the direction of arrow b', while the photoreceptor drum 10 is adapted to be driven for rotation in the direction of arrow c'. Meanwhile, a toner supplying section 28B is defined by a partition plate 33 extending downwardly from the side wall 25*a* of the toner replenishing tank 25 and the front restricting plate 24B, with a toner stirring member 34 arranged to be pivotable in a direction indicated by an arrow e being provided adjacent to the toner supplying section 28 as shown. Although not particularly shown, the toner replenishing tank 25 is extended towards the right in FIG. 6 so that pressure due to the weight of the toner within the toner replenishing tank 25 will not be applied onto the developing sleeve 21 directly.

Since other parts and effects of the developing apparatus 20B of FIG. 6 are generally similar to those of the developing apparatus 20 of FIGS. 2 and 3, a detailed description thereof is abbreviated here for brevity, with like parts being designated by like reference numerals.

As is seen from the foregoing description, according to the first and second embodiments of the present invention, since the chamber is formed between the bristle height restricting member and the front restricting member provided at the upstream side thereof, the developing material transported to the developing region stays in the chamber so as to be stirred and mixed, whereby the undesirable dispersion or diffusion of the carrier into the toner contained in the toner replenishing tank is prevented, thus making it possible to maintain a constant toner concentration at the developing region at all times. In other words, it becomes possible to set the toner concentration correctly as desired by preliminarily adjusting the amount of carrier supplied. Furthermore, during passage of the developing material through the chamber, the toner and carrier are subjected to a sufficient triboelectric charging, and moreover, a so-called filter effect, by which the irregular toner concentration in the axial direction of the developing sleeve can be rapidly eliminated, can be achieved.

Figure 7:
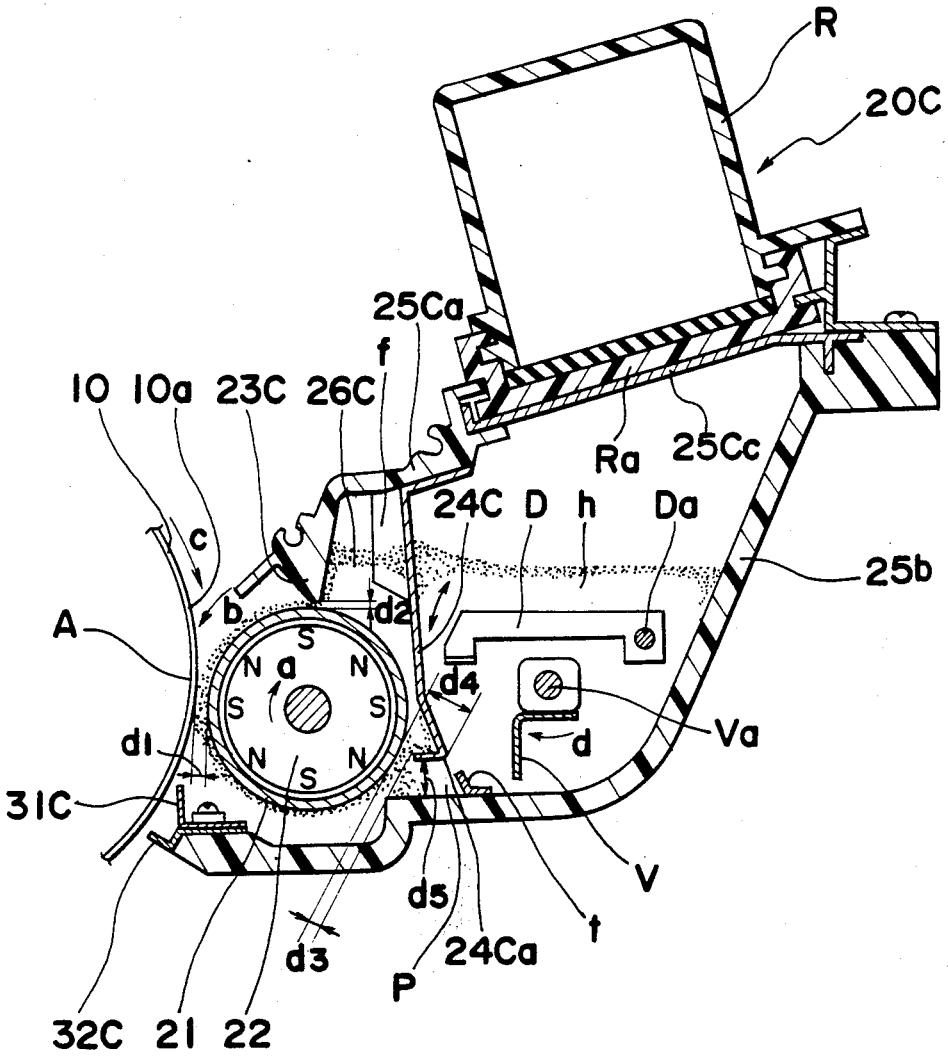
FIG. 7 is a view similar to FIG. 2, which particularly shows a third embodiment thereof.

Referring further to FIG. 7, there is shown a dry process developing apparatus 20C according to a third embodiment of the present invention, which is intended to eliminate a phenomenon still present in the arrangement of FIGS. 2 and 3, that the magnetic carrier tends to be dispersed into the toner contained in the toner replenishing tank 25 from the outer peripheral surface of the developing sleeve 21 particularly when the developing apparatus of FIGS. 2 and 3 is operated for a long period of time. The dispersion of the magnetic carrier as described above may result in an inconvenience in that the toner concentration of the magnetic developing material prepared on the outer peripheral surface of the developing sleeve is raised more than necessarily, and the axial irregularity in the toner concentration is caused if the dispersion of the carrier is not uniform in the axial direction.

In the developing apparatus 20 of FIG. 3, the problems as described above are considered to result from the following causes.

(i) The toner supplied at a position X1 is mixed and stirred with the magnetic carrier before it is transported up to a position X2, and the magnetic carrier slightly raised on the outer peripheral surface of the developing sleeve 21 may be restricted at the forward edge of the front restricting plate 24.

(ii) The position and direction in which the toner is supplied are as indicated by an arrow Y1 while the position and direction in which the magnetic carrier may be dispersed are as shown by an arrow Y2, and it is rather difficult to effectively prevent the magnetic carrier from dispersing. Therefore, a small amount of magnetic carrier is gradually dispersed into the toner replenishing tank 25.

In the dry process developing apparatus 20C in FIG. 7, a bristle height restricting plate 23C is integrally formed with the inner face of the inclined upper wall 25Ca of the toner replenishing tank **25*b* in a position upstream of the developing region A in the developing material transporting direction, while a front restricting plate 24C is fixed, at its upper portion, to a ceiling of the toner replenishing tank 25*b*, with the lower portion of the plate 24C confronting the outer peripheral surface of the developing sleeve 21 at the upstream side of the bristle height restricting plate 23C. This front restricting plate 24C functions as a partition plate for dividing the interior of the toner replenishing tank 25*b* into a developing section and a toner containing section h, and also forms a toner supply passage p between its lower horizontal portion 24Ca and the bottom of the tank 25*b*. The above passage p communicates the toner containing section h with the outer peripheral surface of the developing sleeve 21**, and is provided with a supply restricting plate t disposed at the inlet side thereof.

Moreover, between the bristle height restricting plate 23C and the front restricting plate 24C, a chamber 26C for being loaded the magnetic carrier therein is formed so as to open only towards the outer peripheral surface of the developing sleeve 21. The front restricting plate 24C is provided, on its portion located within the chamber 26C, with many fins f which are attached thereto so as to be inclined in the axial direction of the developing sleeve 21 and which function for stirring the magnetic developing material in the axial direction of the developing sleeve 21 within the chamber 26C. The developing material scattering preventing plates 31C and 32C provided on the lower edge of the toner replenishing tank **25*b*** and below the developing region A are made of magnetic material for magnetically attracting thereto the magnetic toner scattering from the developing region A.

On the other hand, at the bottom portion of the toner containing section h of the toner replenishing tank **25*b*, there are provided a toner send-out vane V and a toner-empty detecting plate D. The toner send-out vane V is arranged to be driven for rotation about a support shaft Va at a constant speed in the direction indicated by an arrow d, and by the above rotation, supplies the toner, through the passage p, to the magnetic developing material circulated for transportation over the outer peripheral surface of the developing sleeve 21. Meanwhile, the toner empty detecting plate D is pivotally supported about a pivotal shaft Da, and is adapted to be moved upwardly when the toner send-out vane V rotating in the direction of arrow d is brought into contact therewith, and to be moved downwardly by its weight when released from contact with said vane V. The time required for this downward movement varies according to the amount of toner contained in the tank 25*b*, i.e., the time becomes short as the amount of toner is decreased due to reduction of resistance. Therefore, the toner amount is detected by measuring the above time for the downward movement of the plate D with a proper switching means for external display when the tank 25*b*** becomes empty.

Moreover, at the upper portion of the toner replenishing tank **25*b*, there is detachably mounted a cartridge R for toner replenishment. The toner preliminarily contained in the cartridge R is fed into the toner containing section h by withdrawing a cartridge lid Ra together with the lid member 25Cc of the tank 25*b***.

The function of the dry process developing apparatus 20C having the construction as described so far will be explained hereinbelow.

In the first place, the magnetic carrier prepared, for example, by preliminarily mixing strong magnetic particles with binder type particles is loaded into the chamber 26C, and after this developing apparatus is operated for preparation, toner is loaded into the toner containing section h. In the above case, the magnetic carrier loaded into the chamber 26C may be a magnetic carrier composed only of strong magnetic particles or that prepared by preliminarily mixing toner into the magnetic carrier. Thus, in the above state, it becomes possible to effect the development of electrostatic latent images by this developing apparatus.

Here, by the rotation of the magnet roller 22 in the direction of arrow a and also, the rotation of the developing sleeve 21 in the direction of arrow b, the toner is transported along the outer peripheral surface of the developing sleeve 21 in the direction of arrow b, and during passage through the chamber 26C, is stirred and mixed with the magnetic carrier, and thus the toner and the magnetic carrier are respectively subjected to triboelectric charging. As a result of the above mixing and stirring, the toner and the magnetic carrier, which are the respective compositions of the magnetic developing material, are combined at this timepoint, into one developing material at a constant mixing ratio at all times, and at the developing region A, magnetic brush bristles made of the magnetic developing material are positively formed. The magnetic brush bristles thus formed rub against the photosensitive surface 10*a* of the photoreceptor drum 10 for developing the electrostatic latent image formed on the surface 10*a* into a visible toner image. After being used for the developing, the magnetic developing material remaining on the outer peripheral surface of the developing sleeve 21 reaches the outlet side of the toner supply passage p, where it is supplied with the toner through the pivotal movement of the toner send-out vane V so as to be subsequently employed for the developing again.

For the developing bias, DC voltage is applied to the developing sleeve 21 based on ordinary practice, but such DC voltage have superposed therein an AC voltage or the developing sleeve 21 may be suitably grounded for this purpose.

Incidentally, when the developing apparatus 20C described so far is employed, there is no tendency that the magnetic carrier is dispersed into the toner contained in the toner containing section h even during operation for a long period of time, and such favorable effect is considered to be due to the reasons as described below.

(i) Although the transported amount of the magnetic developing material reaching the developing region A is restricted by the bristle height restricting plate 23C, the front restricting gap formed between the front restricting plate 24C and the developing sleeve 21 is set to be larger than the bristle height restricting gap formed between the bristle height restricting plate 23C and the developing sleeve 21, whereby in principle, all the magnetic carrier reaches the chamber 26C through the front restricting gap.

(ii) Toner is supplied through the toner supply passage p to the magnetic developing material in the course of transportation, and simultaneously with the supply of toner, the restriction by the front restricting plate 24C is effected.

In other words, the toner supplied to the developing material and the magnetic carrier are not mixed and stirred into each other by the time when the restriction by the front restricting plate 24C is effected after supply of the toner, and thus, there is no tendency that the layer thickness of the magnetic developing material is increased. More specifically, when the toner is consumed by the developing, the layer thickness of the magnetic developing material is reduced by the amount of consumption, and even if the toner is supplied thereto, it is located radially outwardly of the magnetic developing material if there is no mixing and stirring, and thus, only the toner thus supplied is restricted by the front restricting plate 24C. Accordingly, the magnetic developing material itself is not restricted by the front restricting plate 24C, and there is no such inconvenience that the magnetic carrier raised off the sleeve 21 by the increase of the layer thickness is restricted by the front restricting plate 24C so as to be dispersed.

(iii) The toner is supplied with respect to the place and direction in which the magnetic carrier tends to be dispersed into the toner contained in the toner containing section h, and furthermore, the toner is imparted with transporting force by the rotation of the toner send-out vane V.

More specifically, the developing material located in the passage p moves towards the right in FIG. 7 through said passage p by the restricting action of the front restricting plate 24C and the transporting force with respect to the developing material in the direction indicated by arrow b, and tends to leave the outer peripheral surface of the developing sleeve 21. However, in the passage p, the toner is supplied with the transportation force towards the left in FIG. 7 by the rotation of the toner send-out vane V in the direction of arrow d, thus suppressing the dispersion of the magnetic carrier.

On the other hand, in the chamber 26C, the magnetic carrier and toner restricted by the bristle height restricting plate 23C stay so as to be mixed and stirred, and particularly, are sufficiently stirred also in the axial direction of the developing sleeve 21 by the fins f described earlier. Thus, the toner concentration of the magnetic developing material which forms the magnetic brush at the developing region A is determined by the amount of the magnetic carrier staying in the chamber 26C. Accordingly, the toner concentration at the developing region A is maintained at a constant value at all times, and it is possible to adjust such toner concentration according to the amount of magnetic carrier preliminarily loaded in the chamber 26C.

Hereinbelow, there is shown one example of data obtained by experiments carried out by the present inventors through employment of the dry process developing apparatus 20C as described in the foregoing. The experiments were effected through alterations of kinds or mixing ratios of toner and magnetic carrier or through variations of developing conditions such as the developing gap, bristle height restricting gap, front restricting gap, etc. respectively giving favorable results.

(EXPERIMENT IV)

Magnetic carrier: prepared by mixing 25 g of ferrite carrier F-141 (name used in trade and manufactured by Nippon Iron Powder Co., Ltd. Average particle diameter 50 μm) with 25 g of binder type carrier (average particle diameter 37 μm, magnetic powder content 66 wt%) made by dispersing magnetic powder into a resin.

Toner: charging type magnetic toner

Magnetic powder content: 30 wt%

Developing conditions

Developing sleeve:

Outer diameter: 24.5 mm
Revolutions: 79 rpm (in the direction of arrow b)
Magnet roller:
Magnetic force: 750 G
No. of poles: 8
Revolutions: 900 rpm (in the direction of arrow a)
Developing gap (d1): 0.45 mm
Bristle height restricting gap (d2): 0.35 mm
Front restricting gap (d3): 1.5 mm
Supply passage length (d4): 5.5 mm
Supply passage height (d5): 3.5 mm
Processing speed (circumferential speed of photoreceptor drum): 112 mm/sec
Electrostatic latent image potential: +500 V (max. potential)
Developing bias:
DC +200 V
AC 600 Hz, 350 Vrms
Toner supply vane:
Revolutions: 60 rpm (in the direction of arrow d)

In the above experiment, although 100,000 copy paper sheets were subjected to copying, no dispersion of the magnetic carrier into the toner contained in the toner containing section h was observed and copied images were favorable to the last sheet, without any deterioration of the magnetic carrier itself.

Meanwhile, the toner concentration at the developing region A was maintained at 25 wt%, and it was possible to alter the toner concentration within the range of 15 to 50 wt% upon variation of the amount of magnetic carrier to 30 to 60 g.

The length of the toner supply passage d4 should preferably be longer than 3 mm, and was favorable in the range between about 4 and 10 mm. If the length d4 is too short, dispersion of the magnetic carrier is noticed, while when it is too long, supply of the toner becomes insufficient. The toner supply passage height d5 should preferably be lower than 8 mm, and was favorable at about 2 to 7 mm. If the passage was too narrow, supply of the toner became insufficient, while when it was too wide, dispersion of the magnetic carrier was noticed, and thus, the function as the toner supply passage p can not be achieved if the dimensions are out of the above range. It is to be noted here, however, that the values of this kind and the toner concentration, etc. are to be properly determined by the magnetic force of the magnet roller 22, and kinds of the magnetic carrier and toner, etc., and can not be solely decided by one factor.

It should be noted here that the supply restricting plate t provided at the inlet side of the toner supply passage p is not necessarily required in the present invention, but has an effect to reduce the pessure of the toner within the toner supply passage p. Since the toner supply passage p is narrow, there is a possibility that toner is hardened by the pressure if the toner employed is not very good in fluidity, and the plate t has for its object to prevent such undesirable hardening. Accordingly, the supply restricting plate t may be replaced by another member having a function to reduce the direct pressure from the toner send-out vane V. For example, a wire mesh or the like can be provided at the inlet side of the toner supply passage p or a permanent magnet or magnetic plate can be embedded in the bottom portion of the passage p. However, since such a magnetic plate is adapted to reduce the supply pressure by being magnetized through the magnetic force of the magnet roller 22, it may be used only for an apparatus of a stationary magnet roller type.

Moreover, the fins f provided in the space chamber 26C are not necessarily required for the present invention, but these fins f have an effect to improve stirring of the magnetic developing material within the chamber 26C. Therefore, to obtain a similar effect, the fins f may be replaced, for example, by rod-like members made of a magnetic material and axially provided in the chamber 26C. In the above case, the magnetic rod-like members are magnetized by the magnetic force of the magnet roller 22, and from therearound the magnetic field for the stirring. Accordingly, such rod-like members are particularly effective for the developing apparatus of the magnetic roller rotating type as in the present embodiment.

On the other hand, the toner supply passage p is not necessarily required to be formed by the front restricting plate 24C itself, and the configuration of the front restricting plate 24C itself may be suitably determined as desired so long as the object of the present invention can be achieved thereby. For example, the lower horizontal portion 24Ca of the front restricting plate 24C may be folded in a direction opposite to that in FIG. 7.

As is clear from the foregoing description, according to the third embodiment of the present invention, since the toner supply passage is formed at the upstream side of the front restricting member in the state for communication of the toner replenishing tank with the outer peripheral surface of the developing sleeve, while the toner supplying means for feeding out the toner in the direction towards the outer peripheral surface of the developing sleeve through the toner supply passage is provided in the toner replenishing tank, the undesirable dispersion of the magnetic carrier in the magnetic developing material circulated for transportation in one direction over the outer peripheral surface of the developing sleeve, into the toner contained in the toner replenishing tank during operation of the developing apparatus, may be positively prevented, and thus, it becomes possible to obtain developed image of a good image quality over a long period.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A dry process developing apparatus for use in carrying out an image forming process, which apparatus comprises:

a developing sleeve having a magnet member provided therein and having a developing region at a position along the periphery thereof;

a driving means for driving and rotating the developing sleeve and/or the magnetic member so as to transport a developing material along the outer peripheral surface of said developing sleeve;

a bristle height restricting member provided adjacent said developing sleeve at the upstream side, relative to the direction of transportation of the developing material, of the developing region for restricting the height of magnetic brush bristles;

a front restricting member spaced along said developing sleeve from the upstream side of said bristle height restricting member;

a chamber for carrier accommodation between said restricting members and open toward the outer peripheral surface of said developing sleeve and in which magnetic carrier can be loaded and having a wall which is upstream relative to the direction of transportation of the developing material and a wall which is downstream relative to said direction; and a toner supply means for supplying the toner to the outer peripheral surface of the developing sleeve on the upstream side of said front restricting member;

said front restricting member defining the upstream wall of said carrier accommodation chamber and also being a wall of said toner supply means which is downstream, relative to the direction of transportation of the developing material, on said toner supply means and being at a position along said developing sleeve where the surface of said sleeve is moving upwardly and having the end toward said surface being spaced from the peripheral surface of said developing sleeve sufficiently to permit carrier and toner to pass said front restricting member without disturbing the layer of carrier on said developing sleeve, and said bristle height restricting member defining the downstream wall of said carrier accomodation chamber and extending substantially radially of said developing sleeve and having the radially inner end spaced a predetermined distance from the peripheral surface of said developing sleeve for causing the toner and carrier which do not pass beneath said radially inner end to strike the upstream facing surface of said bristle height restricting member and be deflected away from said developing sleeve and then to circulate within said carrier accommodation chamber for thoroughly mixing the toner and carrier and triboelectrically charging said toner;

whereby the magnetic developing material composed of a mixture of the magnetic carrier and toner is supplied to the outer peripheral surface of said developing sleeve to develop an electrostatic latent image supported on a surface of an electrostatic latent image support member at the developing region by using said magnetic developing material.

2. A dry process developing apparatus as claimed in claim 1 wherein said carrier accommodation chamber is open toward the upper part of the outer peripheral surface of said developing sleeve.

3. A dry process developing apparatus as claimed in claim 1 wherein said bristle height restricting member and the outer peripheral surface of said developing sleeve have a first gap therebetween and said front restricting member and the outer peripheral surface of said developing sleeve have a second gap therebetween, said first gap being smaller than said second gap.

4. A dry process developing apparatus as claimed in claim 1 wherein said front restricting member and the outer peripheral surface of the developing sleeve have a second gap therebetween, and the gap between the surface of said electrostatic latent image support member and the outer peripheral surface of said developing sleeve is smaller than said second gap.

5. A dry process developing apparatus as claimed in claim 1 further including a stirring means provided in said carrier accommodating chamber for stirring the developing material within said chamber in the axial direction of said developing sleeve.

6. A dry process developing apparatus as claimed in claim 1 wherein said carrier accommodating chamber is defined between said bristle height restricting member and said front restricting member.

7. A dry process developing apparatus as claimed in claim 1 wherein said toner supply means further includes a toner tank and a toner supply passage between said toner tank and the outer peripheral surface of said developing sleeve, and a toner send-out means within said toner tank for sending out the toner contained in said toner tank and causing the toner to pass through said toner supply passage.

8. A dry process developing apparatus as claimed in claim 7 wherein said toner send-out means includes a toner send-out vane and means for rotating said toner send-out vane.

9. A dry process developing apparatus as claimed in claim 7 further including a pressure suppressing means in said toner supply passage for suppressing pressure applied to the toner by the functioning of said toner send-out means.

10. A dry process developing apparatus as claimed in claim 7 wherein said toner supply passage is defined between said front restricting member and said toner replenishing tank.

* * * * *